United States Patent [19]

Worrallo

[11] Patent Number: 4,938,444

[45] Date of Patent: Jul. 3, 1990

[54] SUPPORT STRUCTURE

[76] Inventor: Anthony C. Worrallo, 77 Beaconsfield Road, Blackheath, London. SE3 7LG, United Kingdom

[21] Appl. No.: 316,947

[22] Filed: Feb. 28, 1989

[30] Foreign Application Priority Data

Mar. 4, 1988 [GB] United Kingdom ..... 8805254

[51] Int. Cl.[5] ..... A47F 7/00

[52] U.S. Cl. ..... 248/297.2; 108/148; 248/244

[58] Field of Search ..... 248/295.1, 296, 297.2, 248/297.3, 244, 245, 246; 108/148, 106, 96; 211/187

[56] References Cited

U.S. PATENT DOCUMENTS

| | | | |
|---|---|---|---|
| 766,605 | 8/1904 | Dilg | 248/246 |
| 957,324 | 5/1910 | Gall | 248/245 X |
| 4,421,289 | 12/1983 | Sturm | 248/246 |
| 4,669,692 | 6/1987 | Mastrodicasa | 248/250 |
| 4,691,887 | 9/1987 | Bessinger | 248/250 |

FOREIGN PATENT DOCUMENTS

| | | | |
|---|---|---|---|
| 835777 | 3/1970 | Canada | 248/246 |
| 1127959 | 9/1968 | United Kingdom . | |
| 1523264 | 8/1978 | United Kingdom | 248/245 |
| 1600178 | 10/1981 | United Kingdom . | |
| 2090518 | 9/1984 | United Kingdom . | |

*Primary Examiner*—David L. Talbott

*Attorney, Agent, or Firm*—Roylance, Abrams, Berdo & Goodman

[57] ABSTRACT

A support structure (2) comprising a bracket (4) and a mounting element (6) on which the bracket (6) is mountable, the bracket (6) having a main portion (8) and a neck portion (10) extending from the main portion (8), and the mounting element (6) having a first opening (12) which is defined by a first pair of lips (14) and which leads to a first channel (16), and a second opening (18) which is defined by a second pair of lips (20) and which leads to a second channel (22), the second opening (18) being bridged by a flexible member (24) which is engaged by a first part (28) of the neck portion (10) of the bracket (4), and the first opening (12) and the first channel (16) being for receiving the neck portion (10) of the bracket (4) with the first pair of lips (14) defining abutment surfaces (30) for being engaged by second parts (32) of the neck portion (10) of the bracket (4).

10 Claims, 3 Drawing Sheets

SUPPORT STRUCTURE

This invention relates to a support structure. The support structure may be used, for example, for supporting shelving fixed to a wall or it may form part of various types of different pieces of furniture.

Support structures comprising a bracket and a mounting element on which the bracket is mountable are well known. Such support structures are shown, for example, in United Kingdom patent Nos. 1600178 and 2090518. With modern technology and constantly changing design trends, there is always a need for support structures which differ in various ways from existing support structures, for example by being easier to manufacture and/or by being aesthetically more pleasing.

In accordance with the present invention, there is provided a support structure comprising a bracket and an elongate mounting element on which the bracket is mountable, the bracket having a main portion and a neck portion extending from the main portion, and the mounting element having a front wall, a rear wall, a pair of side walls, a first opening which is in the front wall and which leads to a first channel, a first pair of lips which form the front wall and which define the first opening, a second opening which is inside the mounting element and which leads to a second channel, a second pair of lips which define the second opening, and a flexible member which is mounted on the second pair of lips such that it bridges the second opening and is for being deformed by a first part of the neck portion of the bracket, the first opening and the first channel being for receiving the neck portion of the bracket with the first pair of lips defining abutment surfaces for being engaged by second parts of the neck portion of the bracket, and the second pair of lips being spaced apart from the rear wall such that the flexible member is mounted solely on the second pair of lips and does not engage the rear wall whereby the second channel is of such a size that it is able to receive electrical wires and heads of fixing means without the electrical wires and heads of fixing means interfering with the deformation of the flexible member by the first part of the neck portion of the bracket during locating of the bracket in a desired position along the mounting element.

The support structure of the present invention is such that the first channel receives the neck portion of the bracket. The abutment surfaces are engaged by the neck portion and friction is generated to keep the bracket in place on the support structure. As indicated above, the second channel is left free so that it can take support services such for example as electrical wires. Furthermore, any fixing screws, fixing bolts or the like employed to secure the mounting element in position, for example against a wall, can be such that they are located in the second channel and thus do not interfere with the connection of the bracket to the mounting element. For example, there is no fear of the neck portion of the bracket engaging the head of a screw and causing deformation of some part of the support structure.

Usually, the mounting element will be an elongate mounting element and the bracket will usually fit into the first channel such that the neck portion of the bracket is passed through the first opening in one relative position, and then the bracket is turned to cause the required engagement of the various parts of the neck portion of the bracket with the abutment surfaces. This locating action of the bracket in the mounting element is described in detail in the above mentioned United Kingdom patents.

The flexible member may be made of a plastics material or a rubber material. Any suitable and appropriate type of plastics material may be employed such for example as polyvinyl chloride. Similarly, any suitable and appropriate type of rubber material may be employed such for example as neoprene.

Preferably, the flexible member is held in position on the second pair of lips by its own resilience.

The flexible member may be made to be slightly oversize so that it needs to be bowed and flexed to be inserted into the second opening. Alternatively or in addition, the flexible member may be provided with retaining grooves for receiving the edges of the second pair of lips. If desired, the second pair of lips could be provided with grooves for receiving the flexible member.

The flexible member would usually be an elongate member which will extend the length of the mounting element so that the bracket or a plurality of brackets can be located where desired along the length of the mounting element.

Preferably the part of the neck portion of the bracket that engages the flexible member is a boss member. The boss member may be of any desired and suitable shape, with a dome shape being preferred. The boss member presses into the flexible material to thus provide positive locating means for locating the bracket in a desired position along the length of the mounting element.

Preferably, the abutment surfaces are serrated. This gives more positive locating of the bracket to the mounting element. The abutment surfaces can however be plain if desired.

The neck portion may be provided with teeth for engaging the serrated abutment surfaces. This gives especially good retaining contact between the bracket and the mounting element.

The bracket may be of various different designs. Thus, for example, the main portion of the bracket may have means for receiving an extension arm. The means for receiving the extension arm may include an upstanding web formed on a top part of the main portion of the bracket.

If desired, the main portion of the bracket may have means for receiving at least one piece of flexible material. The means for receiving the said at least one piece of flexible material may be a groove formed in a top part of the main portion of the bracket. Instead of employing a groove, an upstanding web could be employed. The flexible material may be employed in the form of separate pads or in the form of a single strip of flexible material. A shelf, for example a glass shelf, may then rest on the flexible material and be supported against scratching and in a manner which can absorb shocks.

If desired, the main portion of the bracket may be formed in two parts which are locatable at different desired relative angles to each other to vary the angle of inclination of the main portion of the bracket with respect to the mounting element.

The bracket and the mounting element may be made of any desired and appropriate materials. Thus, for example, the bracket and the mounting element may be made of metals or plastics materials. Presently preferred metals are aluminium and zinc but any other desired and suitable metals may be employed. Where plastics materials are employed, they should be sufficiently robust not to prematurely wear or break. Where plastics materials are employed, different colours can easily be used to give good aesthetic effects.

The bracket may have a main portion which defines a hole in which a shelf can rest. Such a bracket can be formed from strip material, cast or moulded. Such a bracket can also be made out of bar or sheet material.

Where the main portion of the bracket is formed to define a hole in which a shelf can rest, then the bracket may be provided with a groove which opens into the hole part of the bracket and which is for receiving at least one piece of resilient material. The resilient material may be in the form of a plurality of pads or it may be in the form of a single strip of material. The resilient material can be used to take up any slack that may exist when the shelf is placed inside the main portion of the bracket, thereby stopping the shelf from slipping. Embodiments of the invention will now be described solely by way of example and with reference to the accompanying drawings in which:

Figure 1:
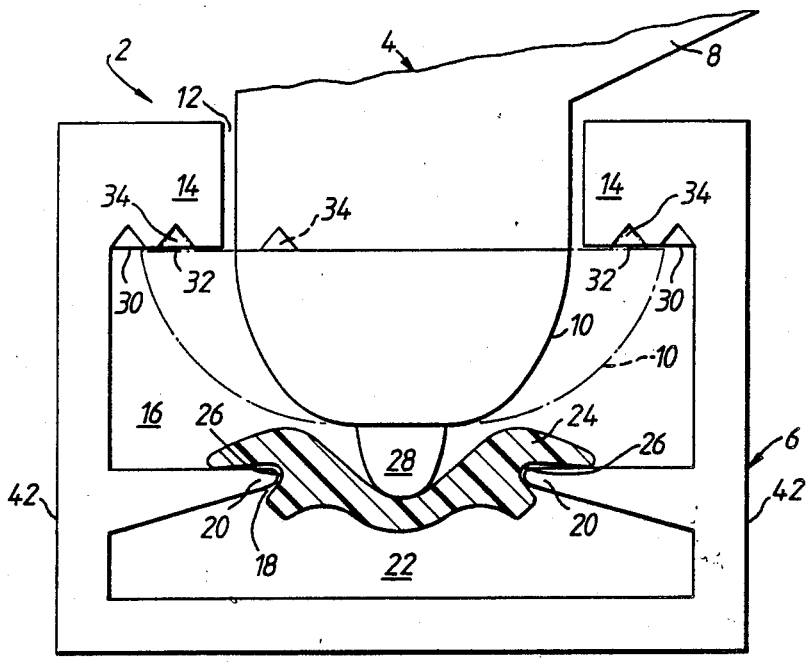
FIG. 1 is a cross section through a first support structure in accordance with the invention.

Referring to FIG. 1, there is shown a support structure 2 comprising a bracket 4 and a mounting element 6 on which the bracket is mountable.

The bracket 4 has a main portion 8 and a neck portion 10 which extends from the main portion 8. As can be seen from FIG. 1, the neck portion 10 is narrower in one direction than it is in another direction.

The mounting element 6 has a first opening 12 which is defined by a first pair of lips 14 and which leads to a first channel 16.

The mounting element 6 also has a second opening 18 which is defined by a second pair of lips 20 and which leads to a second channel 22.

The second opening 18 is bridged by a flexible member 24. The flexible member 24 may be a rubber or plastics flexible member 24. The flexible member 24 is formed to have a pair of side grooves 26 which receive the ends of the lips 20 to locate the flexible member 24 in position. The flexible member 24 will usually be a strip of material which will extend substantially the entire length of the mounting element 6.

The flexible member 24 is engaged by a first part-/boss member 28 on the neck portion 10 of the bracket 4. As can be seen from FIG. 1, the first opening 12 and the first channel 16 receive the neck portion 10 of the bracket 4 with the first pair of lips 14 defining abutment surfaces 30 for being engaged by complementary second parts 32 of the neck portion 10 of the bracket 4. More specifically, the abutment surfaces 30 are serrated as shown and the parts 32 include teeth 34 for engaging in the serrations. Such an arrangement provides a good firm fixing means for fixing the bracket to the mounting element.

Figure 2:
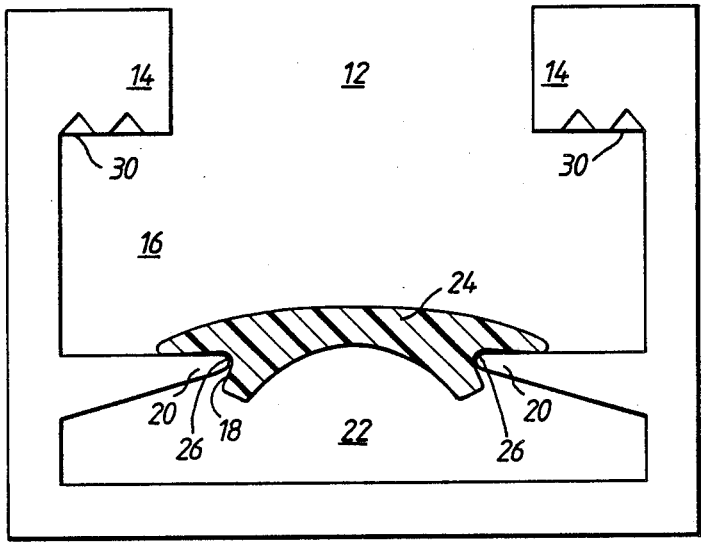
FIG. 2 shows the mounting element of FIG. 1 without the bracket.

Referring now to FIG. 2, it will be seen that there is shown the mounting element 6 shown in FIG. 1 but with the flexible member 24 in an un-deformed shape due to the fact that the bracket 4 is not present and the boss member 28 is thus not pressing on the flexible member 24.

Figure 3:
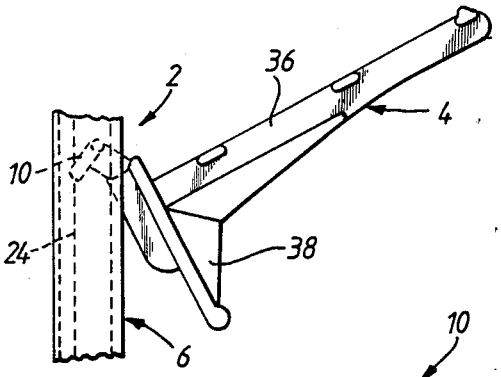
FIG. 3 illustrates somewhat schematically how the bracket of the support structure may fit to the mounting element of the support structure.

FIG. 3 shows somewhat schematically how a bracket 4 may fit to a mounting element 6.

Figure 4:
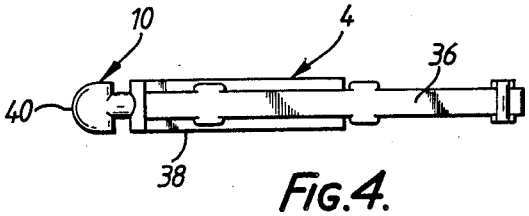
FIG. 4 is a top plan view of the bracket shown in FIG. 3.

FIG. 4 is a top plan view of the bracket 4 shown in FIG. 3. It will be seen that the bracket 4 shown in FIGS. 3 and 4 has an upstanding flange 36, a strengthening web 38 and a different type of neck portion 10 to that shown in FIG. 1. More specifically, the neck portion 10 shown in FIGS. 3 and 4 does not have a separate boss member 28 and in FIG. 1 so that the front part 40 of the neck portion 10 will be the first part that engages in the flexible member 24.

Figure 5:
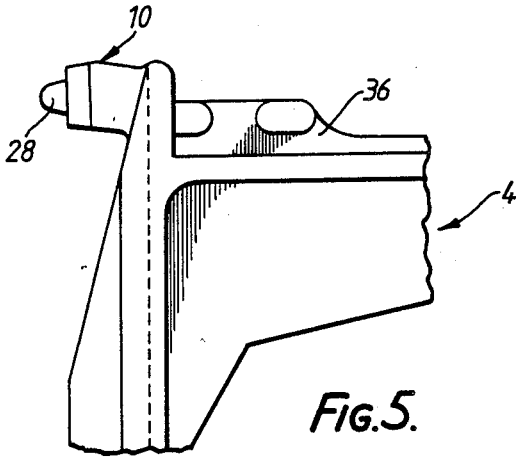
FIG. 5 is a side view of part of a second bracket.

FIG. 5 shows part of a bracket 4 which is similar to the bracket 4 shown in FIGS. 3 and 4 except that the neck portion 10 is provided with a boss member 28.

Figure 6:
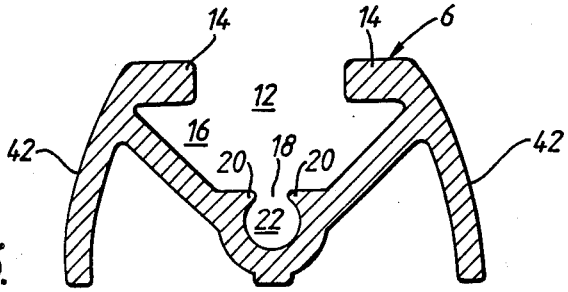
FIG. 6 is a cross section through another type of mounting element that may be employed.

FIG. 6 is a cross section through a mounting element 6 which is of a different shape to the mounting element 6 shown in FIGS. 1 and 2. For ease of comparison and understanding, similar parts have been given the same reference numerals. By comparing FIGS. 1 and 6, it will be seen that the mounting element 6 shown in FIG. 1 has flat side walls 42 and a flat rear mounting wall 44. In contrast, the mounting element 6 shown in FIG. 6 has curved side walls 42 and no rear mounting wall 44. The mounting element 6 may be used in different situations to the mounting element 6 used in FIG. 1. More specifically, the mounting element 6 shown in FIG. 1 will usually be employed for fixing against a wall for forming part of a shelving system, whereas the mounting element 6 shown in FIG. 6 may form part of an item of furniture such for example as a showcase, a display stand, or a screen.

Figure 7:
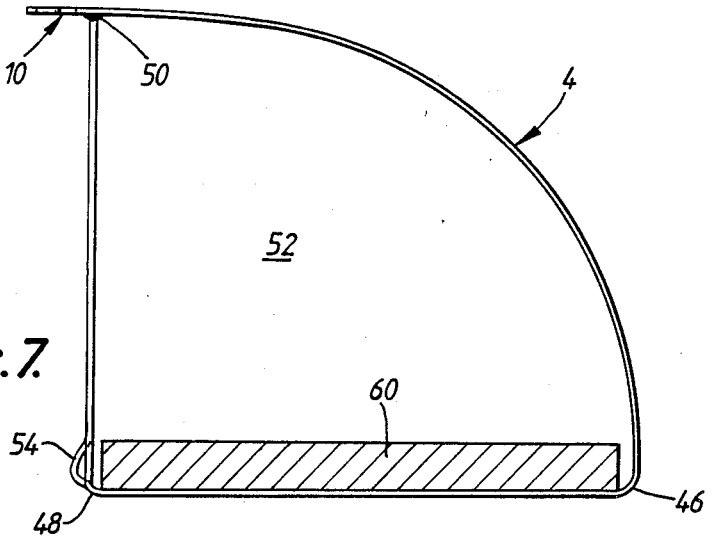
FIG. 7 shows a first preferred bracket.
Figure 8:
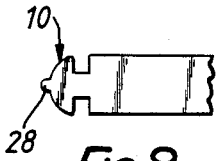
FIGS. 8, 9 and 10 show in more detail various parts of the bracket shown in FIG. 7.
Figure 9:
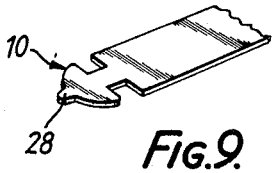
Figure 10:
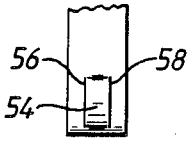

Referring now to FIGS. 7, 8, 9 and 10, there is shown a bracket 4 which is formed of strip material which is bent at positions 46, 48 and which is welded to itself at position 50 to form a closed aperture 52. The bracket 4 is provided with a neck portion 10 which is shaped as shown in FIGS. 7, 8 and 9 and which is formed by cropping. The neck portion 10 is provided with a boss member 28 for engaging the flexible member 24.

Adjacent the bend position 48, there is provided an outward deformation 54. The outward deformation 54 is applied by a cutter/punch tool (not shown) which cuts slits 56, 58 and which then applies pressure from a direction inside the aperture 52 to outside the aperture 52 to push the deformation 54 outwardly as shown in FIG. 7.

The bracket 4 shown in FIGS. 7, 8, 9 and 10 is advantageously able to receive a shelf 60 inside the aperture 52.

Figure 11:
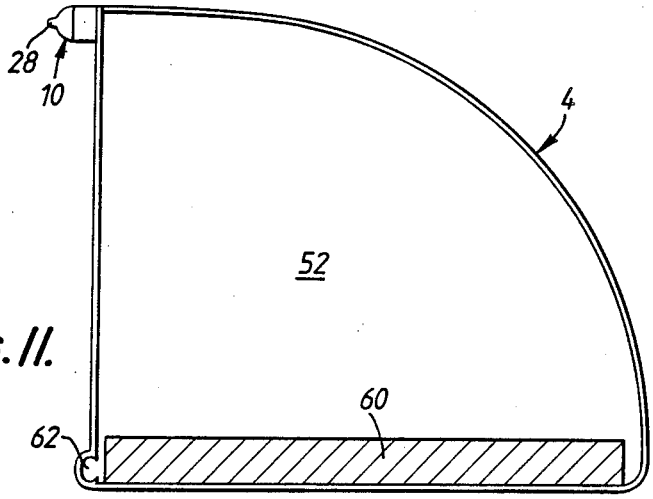
FIG. 11 shows a second preferred type of bracket which is somewhat similar to the bracket shown in FIG. 7.

FIG. 11 shows a somewhat similar bracket 4 to the bracket 4 shown in FIG. 7. The bracket 4 shown in FIG. 11 is however not formed from strip material and it may be cast from a metal such for example as zinc or aluminium, or it may be moulded from a material such for example as a plastics material. Whereas the neck portion 10 of the bracket 4 shown in FIG. 7 is flat due to the fact that strip material is employed, the neck portion 10 in the bracket 4 of FIG. 11 is rounded.

The bracket 4 shown in FIG. 11 is provided with a re-entrant groove 62 which is for receiving a strip of plastics material (not shown). The strip of plastics material can have a head which projects out of the groove 62 and engages the shelf 60. This will take up any play between the shelf 60 and the bracket 4 and will thus locate the shelf 60 firmly in position and will prevent the shelf 60 from slipping.

The support structures of the present invention can be used for a number of different purposes. Thus, for example, the mounting element may be fixed to a wall or it may form an upright of a piece of furniture. In both cases, the mounting element can accept one or more of the brackets. Shelves or other elements can be supported on the brackets. If desired, the mounting element may be a free standing pole having a central core with flanges radiating therefrom. Oppositely directed pairs of lips may be provided at the outer free ends of the flanges thereby to provide the first and second openings and the means for receiving one or more brackets. Still further, the mounting element can be produced as a double sided channel rail so as to support brackets protruding in opposite directions. The ability to use various shapes of mounting element stems from the beneficial locking action of the bracket or brackets to the mounting element. Various types and shapes of bracket may be employed and, if the brackets are not to support shelves, then they may, if desired, be formed to serve as coat and hat hangers, or to serve as light fitting supports, or to support rails on which clothing or other articles can be hung.

It is to be appreciated that the embodiments of the invention described above with reference to the accompanying drawings have been given by way of example only and that modifications may be effected. Thus, for example, the abutment surfaces 30 need not be serrated and teeth 34 need not be employed. Preferably, the width of the flexible member 24 is less than the width of the first opening 12 to facilitate insertion of the flexible member 24 in the mounting element 8 and in position on the lips 20. If desired however, the width of the flexible member 24 can be the same as or greater than the width of the first opening 20, in which case the flexible member 24 will usually be passed through the first opening 12 at an angle. A roller or other suitable and appropriate device may be employed to press the flexible member 24 into position on the lips 20.

I claim:

1. A support structure comprising: a bracket and an elongate mounting element on which the bracket is mountable, the bracket having a main portion and a neck portion extending from the main portion, and the mounting element having a front wall, a rear wall, a pair of side walls, a first opening which is in the front wall and which leads to a first channel, a first pair of lips which form the front wall and which define the first opening, a second opening which is inside the mounting element and which leads to a second channel, a second pair of lips which define the second channel, and a flexible member which is mounted on the second pair of lips such that it bridges the second opening and is for being deformed by a first part of the neck portion of the bracket, the first opening and the first channel being for receiving the neck portion of the bracket with the first pair of lips defining abutment surfaces for being engaged by second parts of the neck portion of the bracket, and the second pair of lips being spaced apart from the rear wall such that the flexible member is mounted solely on the second pair of lips and does not engage the rear wall whereby the second channel is of such a size that it is able to receive electrical wires and heads of fixing means without these electrical wires and heads of fixing means interfering with the deformation of the flexible member by the first part of the neck portion of the bracket during locking of the bracket in a desired position along the mounting element.

2. A support structure according to claim 1 in which the bracket fits into the first channel such that the neck portion of the bracket is passed through the first opening in one relative position, and then the bracket is turned to cause the required engagement of the various parts of the neck portion of the bracket with the abutment surfaces.

3. A support member according to claim 2 in which the flexible member is held in position on the second pair of lips by its own resilience, and in which the flexible member is an elongate member which extends the length of the mounting element so that the bracket or a plurality of brackets can be mounted where desired along the length of the mounting element.

4. A support member according to claim 3 in which the part of the neck portion of the bracket that engages the flexible member is a dome-shaped boss member.

5. A support structure according to claim 4 in which the abutment surfaces are serrated.

6. A support structure according to claim 5 in which the neck portion is provided with teeth for engaging the serrated abutment surfaces.

7. A support structure according to claim 2 in which the main portion of the bracket has means for receiving an extension arm.

8. A support structure according to claim 2 in which the main portion of the bracket has a groove for receiving at least one piece of flexible material.

9. A support structure according to claim 2 in which the main portion of the bracket is formed in two parts which are locatable at different desired relative angles to each other to vary the angle of inclination of the main portion of the bracket with respect to the mounting element.

10. A support structure according to claim 2 in which the main portion of the bracket defines a hole in which a shelf can rest.

* * * * *